US011525345B2

(12) United States Patent
AlSaud et al.

(10) Patent No.: US 11,525,345 B2
(45) Date of Patent: Dec. 13, 2022

(54) METHOD AND SYSTEM FOR MODELING HYDROCARBON RECOVERY WORKFLOW

(71) Applicant: SAUDI ARABIAN OIL COMPANY, Dhahran (SA)

(72) Inventors: Moataz Abu AlSaud, Khobar (SA); Subhash Ayirala, Dhahran (SA); Ali Yousef, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 216 days.

(21) Appl. No.: 16/928,624

(22) Filed: Jul. 14, 2020

(65) Prior Publication Data

US 2022/0019718 A1 Jan. 20, 2022

(51) Int. Cl.
*E21B 43/20* (2006.01)
*E21B 43/16* (2006.01)

(52) U.S. Cl.
CPC ..... *E21B 43/20* (2013.01); *E21B 43/164* (2013.01); *E21B 2200/20* (2020.05)

(58) Field of Classification Search
CPC .... E21B 43/20; E21B 43/164; E21B 2200/20; E21B 41/00
See application file for complete search history.

(56) References Cited

U.S. PATENT DOCUMENTS 7,890,264 B2 * 2/2011 Elphick ..... E21B 43/16 73/152.39
8,776,880 B2 7/2014 Pich et al.
(Continued)

FOREIGN PATENT DOCUMENTS

CA 2974977 A1 8/2016
CN 107269265 A 10/2017
(Continued)

OTHER PUBLICATIONS

Sharma, Himanshu and Kishore K. Mohanty, "An experimental and modeling study to investigate brine-rock interactions during low salinity water flooding in carbonates", Journal of Petroleum Science and Engineering, Elsevier B.V., vol. 165, Nov. 2017, pp. 1021-1039 (19 pages).
(Continued)

*Primary Examiner* — Jay Hann
(74) *Attorney, Agent, or Firm* — Osha Bergman Watanabe & Burton LLP

(57) ABSTRACT

A method for modeling hydrocarbon recovery workflow is disclosed. The method involves obtaining, by a computer processor, stimulation data and reservoir data regarding a region of interest, wherein the stimulation data describe a water flooding process performed in the reservoir region of interest by one or more enhanced-recovery wells. The method may include determining, by the computer processor, a multi-phase Darcy model for the reservoir region of interest using the reservoir data and the stimulation data. The multi-phase Darcy model determines a fluid phase flow rate using a pressure gradient, an absolute permeability value, and a relative permeability value. The method may include determining, by the computer processor, a plurality of relative permeability values for the reservoir region of interest based on a plurality of fluid-fluid interface correlations and an interpolating parameter.

17 Claims, 8 Drawing Sheets

(56) References Cited

U.S. PATENT DOCUMENTS

| | | | | |
|---|---|---|---|---|
| 10,000,687 | B2 | 6/2018 | Al-Yousef et al. | |
| 10,287,486 | B2 | 5/2019 | Ayirala et al. | |
| 11,136,863 | B2 * | 10/2021 | Preux | E21B 43/20 |
| 2002/0035040 | A1 | 3/2002 | Talashek et al. | |
| 2011/0306525 | A1 | 12/2011 | Lighthelm | |
| 2013/0274149 | A1 | 10/2013 | Lafitte et al. | |
| 2014/0163939 | A1 | 6/2014 | Bourbiaux et al. | |
| 2018/0032356 | A1 * | 2/2018 | Su | E21B 43/16 |
| 2018/0291717 | A1 | 10/2018 | Ayirala et al. | |
| 2019/0093469 | A1 | 3/2019 | Williams et al. | |
| 2020/0202056 | A1 * | 6/2020 | Samson | G01V 99/005 |
| 2021/0080371 | A1 * | 3/2021 | Johns | G01V 99/005 |

FOREIGN PATENT DOCUMENTS

| | | | |
|---|---|---|---|
| CN | 108876055 | A | 11/2018 |
| CN | 108952660 | A | 12/2018 |
| EP | 2596208 | B1 | 10/2016 |
| WO | 2005120195 | A2 | 12/2005 |
| WO | 2009035897 | A1 | 3/2009 |
| WO | 2013/117741 | A1 | 8/2013 |
| WO | 2013135639 | A2 | 9/2013 |
| WO | 2015124633 | A1 | 8/2015 |
| WO | 2015153821 | A1 | 10/2015 |
| WO | 2016126252 | A1 | 8/2016 |

OTHER PUBLICATIONS

Ayirala, Subhash C. et al., "Water Ion Interactions at Crude-Oil/Water Interface and Their Implications for Smart Waterflooding in Carbonates", SPE 183894, SPE Journal, Society of Petroleum Engineers, Oct. 2018, pp. 1817-1832 (16 pages).

Korrani, Aboulghasem K.N. and Gary R. Jerauld, "Modeling wettability change in sandstones and carbonates using a surface-complexation-based method", Journal of Petroleum Science and Engineering, Elsevier B.V., vol. 174, Dec. 2018, pp. 1093-1112 (20 pages).

International Search Report issued in PCT/US2020/044496 dated Apr. 1, 2021 (6 pages).

Written Opinion of the International Searching Authority issued in PCT/US2020/044496 dated Apr. 1, 2021 (9 pages).

Martinez-Mendoza, Edgar G. et al., "Capillary pressure and relative permeability estimation for low salinity waterflooding processes using pore network models", ELSEVIER, Journal of Petroleum Science and Engineering, vol. 182, Jul. 10, 2019, pp. 1-18 (18 pages).

Ayirala, Subhash C. et al., "A state of the art review to develop novel workflow for microscopic scale understanding of advanced water flooding mechanisms in carbonates", ELSEVIER, Journal of Petroleum Science and Engineering, vol. 157, Jul. 14, 2017, pp. 530-546 (17 pages).

* cited by examiner

METHOD AND SYSTEM FOR MODELING HYDROCARBON RECOVERY WORKFLOW

BACKGROUND

Maintaining or potentially increasing hydrocarbon (i.e., crude oils, like petroleum and natural gas) production from subterranean formations requires a thorough understanding of the mechanisms associated with hydrocarbon recovery processes. Various methods for recovering hydrocarbons are currently applied to retrieve hydrocarbons in subterranean formations. Such methods include thermal-based processes, gas-based processes, and chemical-based processes. Water or brine injection, also known as waterflooding, is one of the methods applied to improve hydrocarbon recovery. Water or brine injection involves an injection well, which is used to place fluid underground into porous geologic formations.

SUMMARY

In general, in one aspect, embodiments disclosed herein relate to a method for modeling hydrocarbon recovery workflow. The method includes obtaining, by a computer processor, stimulation data and reservoir data regarding a region of interest. The stimulation data describe a water flooding process performed in the reservoir region of interest by one or more enhanced-recovery wells. The method includes determining, by the computer processor, a multi-phase Darcy model for the reservoir region of interest using the reservoir data and the stimulation data. The multi-phase Darcy model determines a fluid phase flow rate using a pressure gradient, an absolute permeability value, and a relative permeability value. The method includes determining, by the computer processor, a plurality of relative permeability values for the reservoir region of interest based on a plurality of fluid-fluid interface correlations and an interpolating parameter. The interpolating parameter determines intermediate relative permeability values of an intermediate salinity-level caused by at least one fluid-fluid interface among the plurality of fluid-fluid interfaces. The method includes determining an amount of hydrocarbon production based on a simulation of the reservoir region of interest using the plurality of relative permeability values.

In general, in one aspect, embodiments disclosed herein relate to a system for modeling hydrocarbon recovery workflow. The system includes a processor and a memory coupled to the processor. The memory includes functionality for obtaining, by the processor, stimulation data and reservoir data regarding a region of interest. The stimulation data describe a water flooding process performed in the reservoir region of interest by one or more enhanced-recovery wells. The memory includes functionality for determining, by the processor, a multi-phase Darcy model for the reservoir region of interest using the reservoir data and the stimulation data. The multi-phase Darcy model determines a fluid phase flow rate using a pressure gradient, an absolute permeability value, and a relative permeability value. The memory includes functionality for determining, by the processor, a plurality of relative permeability values for the reservoir region of interest based on a plurality of fluid-fluid interface correlations and an interpolating parameter. The interpolating parameter determines intermediate relative permeability values of an intermediate salinity-level caused by at least one fluid-fluid interface among the plurality of fluid-fluid interfaces. The memory includes functionality for determining an amount of hydrocarbon production based on a simulation of the reservoir region of interest using the plurality of relative permeability values.

In general, in one aspect, embodiments disclosed herein relate to non-transitory computer readable medium storing instructions executable by a computer processor. The non-transitory computer readable medium includes instructions for obtaining, by a computer processor, stimulation data and reservoir data regarding a region of interest. The stimulation data describe a water flooding process performed in the reservoir region of interest by one or more enhanced-recovery wells. The instructions include determining, by the computer processor, a multi-phase Darcy model for the reservoir region of interest using the reservoir data and the stimulation data. The multi-phase Darcy model determines a fluid phase flow rate using a pressure gradient, an absolute permeability value, and a relative permeability value. The instructions include determining, by the computer processor, a plurality of relative permeability values for the reservoir region of interest based on a plurality of fluid-fluid interface correlations and an interpolating parameter. The interpolating parameter determines intermediate relative permeability values of an intermediate salinity-level caused by at least one fluid-fluid interface among the plurality of fluid-fluid interfaces. The instructions include determining an amount of hydrocarbon production based on a simulation of the reservoir region of interest using the plurality of relative permeability values.

Other aspects of the disclosure will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
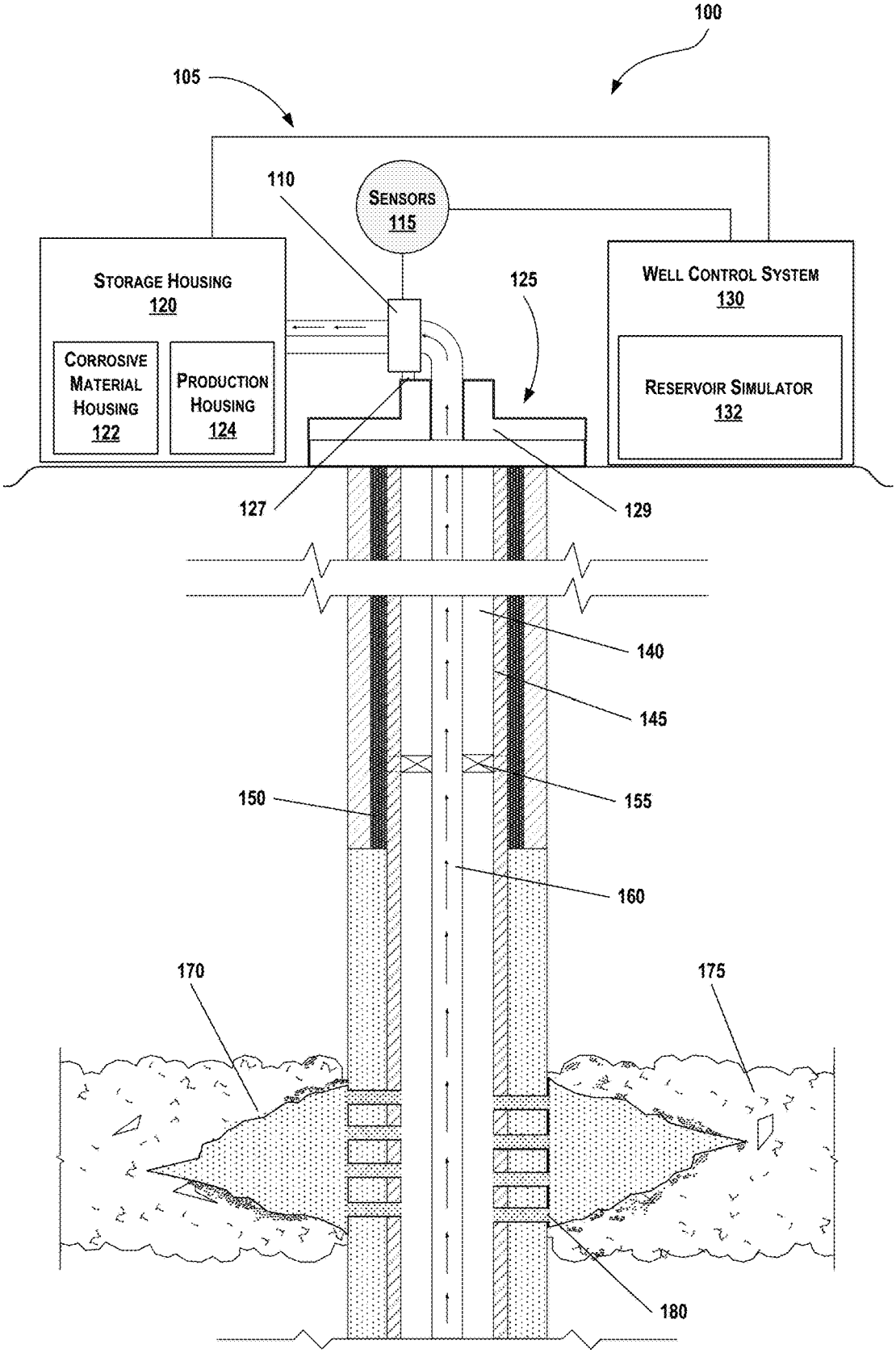
FIG. 1 shows a well system in accordance with one or more embodiments.

Specific embodiments of the disclosure will now be described in detail with reference to the accompanying figures. Like elements in the various figures are denoted by like reference numerals for consistency.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include a method and a system for modeling hydrocarbon (i.e., crude oils, like petroleum and natural gas) recovery workflow based on fluid-fluid interface interactions for advanced waterflooding in porous media. In some embodiments, methodology, models, and workflows for predicting hydrocarbon recovery from subterranean formations are described. In some embodiments, the method and the system relate to generating workflows using fluid-fluid interface interactions identified during transport phenomenon in advanced water flooding processes. In some embodiments, the method and the system include an interpolating parameter that represents the fluid-fluid interactions in the subterranean formation when brine chemistry used in waterflooding differs from existing brine chemistry in a subterranean formation. Hydrocarbon recovery rates for various brine chemistries may be predicted by the method and the system, whereby a specific brine recipe may result in determining optimal waterflooding parameters.

Maintaining or potentially increasing hydrocarbon production from subterranean formations may include a thorough understanding of the mechanisms associated with hydrocarbon recovery processes. Industries have evolved over time to establish various hydrocarbon recovery methods (i.e., also referred to as enhanced oil recovery (EOR) methods) that are currently applied in subterranean formations. These EOR methods may include, but are not limited to, thermal-based processes, gas-based processes, and chemical-based processes. Water or brine injection, also known as waterflooding, may be used to improve hydrocarbon recovery. The source of injected brine may be seawater, underground aquifer, or surface water. The injected brine salinity may have an impact on hydrocarbon recovery processes in both carbonate and sandstone formations. The process of altering the brine chemistry to improve the hydrocarbon recovery from subterranean formations without adding further chemicals or fluids may also be known as low-salinity, smart water, and modified salinity flooding.

In some embodiments, a macroscale model may be established to accurately predict oil recovery in subterranean formations for EOR processes. For a smart waterflooding process, the effect of water chemistry on fluid-fluid and fluid-rock interactions may be incorporated in macroscale transport models. Such interface effects may be computed through reservoir wettability alterations associated with smart water systems. The effect of water chemistry on fluid-fluid interactions may include physicochemical interactions being more complex than a reservoir wettability alteration process. The brine salinity may have an impact on the brine/hydrocarbon rheological properties such as interfacial viscosity and elasticity. Such rheological effects may be crucial for brine and hydrocarbon fluids distribution in subterranean formations having a first order effect on hydrocarbon recovery, which are not currently captured in macroscopic models associated with advanced waterflooding process.

In some embodiments, the method and the system process parameters associated to the advanced waterflooding process by incorporating the brine chemistry effect on the rheological properties at the fluid-fluid interface. The method and the system generate simulation models with increased robustness to provide greater insight on physicochemical interactions relevant to smart waterflooding. These simulation models may aid in defining optimal injected brine parameters tailored for different subterranean reservoirs.

FIG. 1 shows a schematic diagram illustrating a well system 100 that includes a well 105 extending below a surface into a subsurface formation ("formation") 175. Formation 175 may include a porous or fractured rock 170 that resides underground, beneath Earth's surface ("surface"). A subsurface pool of hydrocarbons, such as oil and gas, also known as a reservoir, may be located in formation 175. Well 105 includes a wellbore 150 that extends from a wellhead 125 at the surface to a target zone in formation 175—the target zone may be where the reservoir (not shown separately) is located. Well 105 may further include a casing 145 lining a portion of wellbore 150. In the illustrated example, casing 145 extends into the portion of wellbore 150 penetrating formation 175. One or more perforations 180 are formed in casing 145 to allow fluid communication between formation 175 and well 105. In other implementations, the portion of wellbore 150 penetrating formation 175 may be uncased or open, and fluid communication between formation 175 and well 105 may occur through the open wall section of well 105.

In one example, tubing 160 may be disposed in well 105 to convey fluid into, or away from, well 105. The tubing 160 may extend from a wellhead 125 and seals 129 into casing 145. An annulus 140 is formed between tubing 160 and casing 145. A packer 155 may be disposed in the annulus 140, between casing 145 and tubing 160, to isolate the zone in which fluid is injected into or received from formation 175. If there is a clear path between formation 175 and the bottom opening of tubing 160, fluid may flow from formation 175 into tubing 160 for production or from tubing 160 into formation 175 for injection.

The wellbore 150 may facilitate the circulation of drilling fluids during drilling operations, the flow of hydrocarbon production ("production") (e.g., oil and gas) from the reservoir to the surface during production operations, the injection of substances (e.g., water) into the formation 175 or the during injection operations, or the communication of monitoring devices (e.g., logging tools) into the formation 175 or the reservoir during monitoring operations (e.g., during in situ logging operations). In some embodiments, during operation of the well system 100, the control system 130 collects and records wellhead data for the well system 100.

The well system 100 may include a well control system ("control system") 130. The control system 130 may include flow regulating devices that are operable to control the flow of substances into and out of wellbore 150. For example, well control system 130 may include one or more production valves (not shown separately) that are operable to control the flow of production may control various operations of the well system 100, such as reviving well production operations and subsequent well completion operations, well maintenance operations, and reservoir monitoring, assessment and development operations.

The well system 100 may include various pumps 110 installed near the wellhead 125 for pumping material in and out of the well 105. The pumps 110 may include connections to a port 127 and the well control system 130. A storage housing 120 may be coupled to the pumps 110 for storing one or more types of materials used in stimulation procedures at the well 105. The storage housing 120 may include storage tanks or containers with hydrocarbons extracted from the well 105. The storage housing 120 may include storage tanks or containers with hydrocarbons to be injected into the well 105. The schematic diagram illustrates the well system 100 including connections from the wellhead 125 to the pumps 110. The pumps 110 pumping down or extracting corrosive material from the storage housing 120 into the port 127 and pumping up dissolved well blockage to the storage housing 120. The corrosive material may be stored in a corrosive material housing 122 and production fluid may be stored in a production housing 124. The corrosive material housing 122 and the production housing 124 may be located adjacent to one another or deployed at a distance from one another. Further, the storage housing 120 may be disposed near the well system 100 or at a distance from the well 105.

The well control system 130 may be coupled to sensors 115 to sense characteristics of substances in storage housing 120, including production, passing through or otherwise located in the well system 100. The characteristics may include, for example, pressure, temperature, and flow rate of production flowing through the wellhead 125, or other conduits of the well control system 130, after exiting the wellbore 150.

The sensors 120 may include a surface pressure sensor operable to sense the pressure of production flowing to the well control system 130, after it exits the wellbore 150. The surface pressure sensor may sense the pressure of corrosive material flowing into the well control system 130 before it enters the wellbore 150. The sensors 120 may include a surface temperature sensor including, for example, a wellhead temperature sensor that senses a temperature of production flowing through or otherwise located in the wellhead, referred to as the "wellhead temperature" (Twh). In some embodiments, the sensors 120 include a flow rate sensor operable to sense the flow rate of production flowing through the well control system 130, after it exits the wellbore 150. The flow rate sensor may include hardware that senses the flow rate of production (Qwh) passing through the wellhead.

The well control system 130 includes a reservoir simulator 132. For example, the reservoir simulator 132 may include hardware and/or software with functionality for generating one or more reservoir models regarding the formation 175 and/or performing one or more reservoir simulations. For example, the reservoir simulator 132 may perform reviving analysis and estimation. Further, the reservoir simulator 132 may store well logs and data regarding core samples for performing simulations. While the reservoir simulator 132 is shown at a well site, embodiments are contemplated where reservoir simulators are located away from well sites. In some embodiments, the reservoir simulator 132 may include a computer system disposed to estimate a depth above the packer in which the tubing 160 may be connected. The computer system may also provide real time (i.e., immediate feedback) estimation, based on the feedback from the sensors 120, regarding an amount of corrosive material to pump down through the port 127. The reservoir simulator 132 may include historical data about the well. The historical data may be information including a reservoir depth, a well production rate, a packer depth, a casing depth, and/or a well blockage depth. In this regard, an amount of the non-corrosive material may be determined for pumping down based on the depth estimated. The depth may be estimated based on at least one parameter associated to the non-corrosive material and the historical data of the well. In a process of identifying fluid loading and pumping material into a dead well, these parameters may include well pressure, tubing pressure increased to identify blockage, depth of blockage from a gradient calculation, an amount of non-corrosive material to be pumped, and/or a pump time duration.

Keeping with reservoir simulators, a reservoir simulator 132 may include functionality for solving a multi-phase Darcy equation model to simulate fluid-fluid interface interactions in the reservoir. Specifically, the reservoir simulator may implement a simulation model that uses known subterranean fluid movement parameters and specific material parameters to screen a subterranean area of interest. Upon screening the subterranean area of interest, the simulation model may be used for determining an appropriate water chemistry for injecting in an oil recovery process. As such, the simulation model provides a basis for a precise injection technique for injection wells in order to increase extraction of oil. In the case of solving the multi-phase Darcy equation model, the surface viscosity of the fluid-fluid interface becomes as an input to the relative permeability curve in the multiphase Darcy model.

In some embodiments, during operation of the well system 100, the control system 130 collects and records wellhead data for the well system 100. The wellhead data may include, for example, a record of measurements of wellhead pressure (Pwh) (e.g., including flowing wellhead pressure), wellhead temperature (Twh) (e.g., including flowing wellhead temperature), wellhead production rate (Qwh) over some or all of the life of the reviving well system 100, and water cut data. In some embodiments, the measurements are recorded in real time, and are available for review or use within seconds, minutes or hours of the condition being sensed (e.g., the measurements are available within 1 hour of the condition being sensed). In such an embodiment, the wellhead data may be referred to as "real time" wellhead data. Real time wellhead data may enable an operator of the well system 100 to assess a relatively current state of the well system 100, and make real time decisions regarding development of the well system 100 and the reservoir, such as on-demand adjustments in regulation of production flow from the well.

Figure 2:
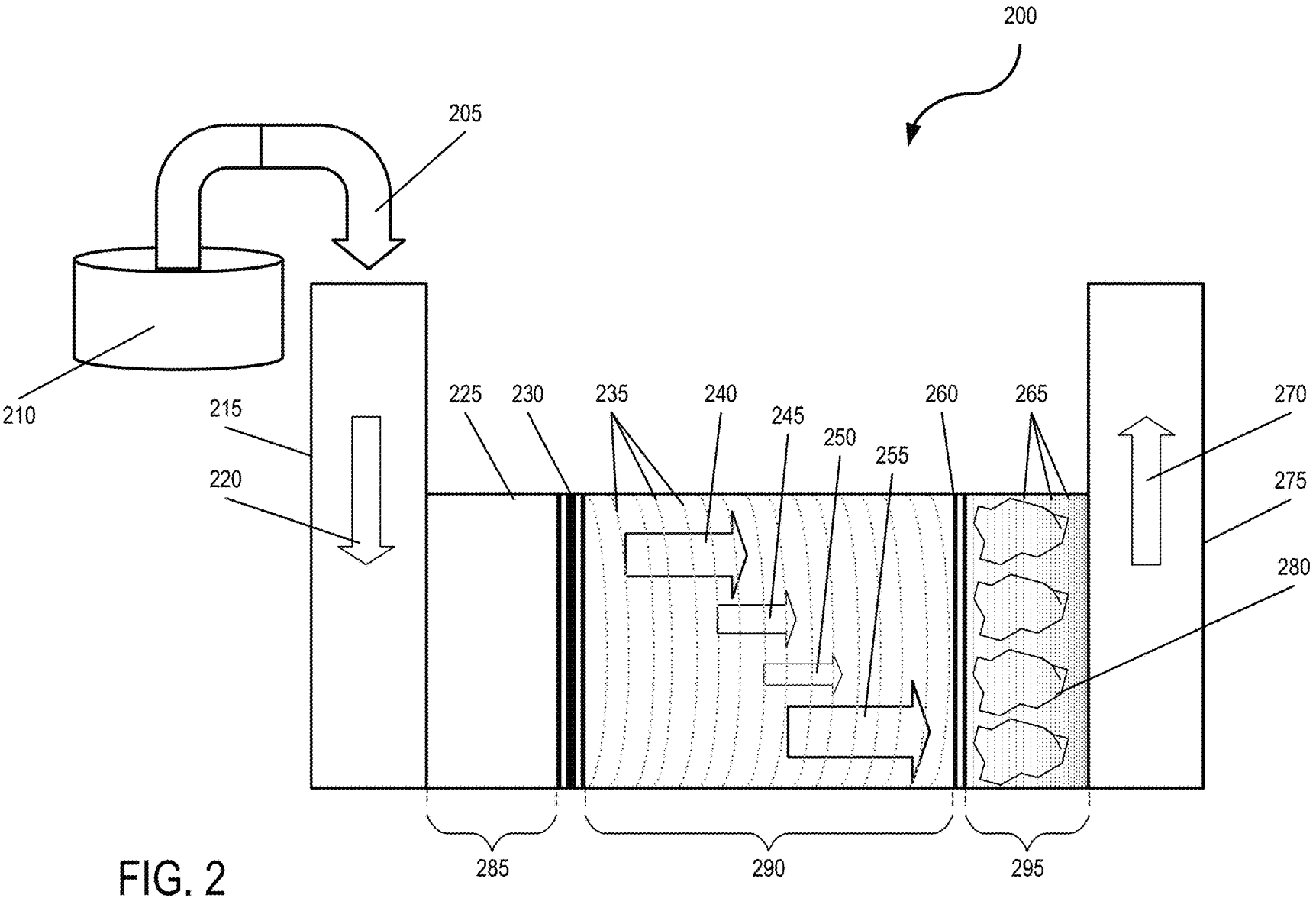
FIG. 2 shows a well system in accordance with one or more embodiments.

Turning to FIG. 2, FIG. 2 shows a diagram of an example system 200 and its use for carbonated water flooding of an underground hydrocarbon reservoir 225, according to certain embodiments of the present disclosure. A vessel 210 may be a housing storage (i.e., such as housing storage 120) including a sealable lid, one or more inlets, or both for introducing water, CO2 gas, and one or more salts (if needed) into the vessel 210. In some embodiments, water is seawater, fresh water (for example, obtained from a lake or well), or a combination of both. In certain embodiments, water is specially tailored as described above (for example, with respect to the concentration and type of salt(s) in the water). In this regard, one or more of the salt(s) may be combined with water prior to introducing the resulting salt-containing water into the vessel 210.

The vessel 210 may be pressurized during the preparation of a volume of carbonated injection water in order to increase the concentration of dissolved CO2 gas in the carbonated injection water. In certain embodiments, the vessel 210 includes an inlet for introducing CO2 gas at a desired pressure. For example, the inlet may include a valve and a pressure a regulator in fluid communication with a pressurized source of CO2 gas (for example, from a storage tank holding CO2 or a mixture that includes CO2 at an increased pressure). The vessel 210 can also include a pressure sensor for monitoring the pressure of gas (for example, CO2) in the vessel 210. The vessel 210 can also include a movable wall (for example, a piston), which may be mechanically adjusted to modify the volume of the vessel 210 and thus to control the pressure of gas (for example CO2) in the vessel 210. For example, the movable wall can be used in concert with pressure sensor and a pressure controller to adjust the carbon dioxide pressure in the vessel 210 to prepare carbonated injection water with a desired concentration of dissolved CO2. For example, the concentration of dissolved CO2 gas may be increased in the carbonated injection water by increasing the pressure under which carbonated injection water is prepared in the vessel 210. In certain embodiments, a volume of carbonated injection water is prepared in the vessel 210 under a pressure of 14150 psi or greater. For example, a volume of carbonated injection water may be prepared in the vessel 210 under a pressure in the range of about 1450 psi to about 7250 psi.

Continuing with FIG. 2, the vessel 210 may be operationally connected to an underground hydrocarbon reservoir 225 via injection well 215, which is in fluid communication with an outlet of the vessel 210 and the reservoir 225. For example, a fluid conduit may operationally connect the outlet of the vessel 210 to the injection well 215. In certain embodiments, an inlet of injection well 215 includes a valve that allows selection of one or more injection streams, where one of the injection streams includes a carbonated injection 205. Other injection streams can include a chase fluid, as described previously. Example system 200 may further include one or more mechanical pumps (for example, high pressure pumps), one or more valves, one or more flow meters, one or more controllers, or combinations of these for controlling the flow rate of the carbonated injection 205 into injection well 215. In certain embodiments, the carbonated injection 205 is introduced through the outlet of the vessel 210 at an injection flow rate 220 in the range of 0.5 to 2 m^3/min.

In certain embodiments, the vessel 210 may be made out of iron-based metal (for example, stainless steel) or another corrosion resistant material. The vessel 210 may also include a mixer to facilitate efficient and effective contact of the water with CO2, salt(s), or both. For example, a mixer may allow the carbonated injection 205 to be more quickly saturated with CO2 gas. In certain embodiments, the mixer is designed and operated to minimize pressure drops within the vessel 210. For example, the mixer may be sized to minimize pressure drops within the vessel 210, and the mixer may be operated at a rotation rate that minimizes pressure drops within the vessel 210.

In FIG. 2, the vessel 210 is temperature-controlled for the preparation of a volume of carbonated injection 205. For example, the vessel 210 may include one or more heating elements, one or more cooling elements, a temperature controller, or combinations of these. For example, the vessel may include one or more heating coils. For example, the vessel 210 may include a circulating water bath surrounding or in contact with one or more external surfaces of the vessel 210. The temperature of the circulating water bath may be adjusted, for example, by the temperature controller, to increase or decrease the temperature of the vessel. The temperature controller may be in electronic communication with one or more temperature sensors, which may be located, for example, at the inlet, middle, outlet, or combinations of these of the vessel 210 to ensure a uniform temperature is achieved inside the vessel 210. The temperature controller may adjust the extent of heating or cooling (for example, via an electronic signal transmitted to the heating element(s), cooling element(s), or both) based on temperature measurement data transmitted by the sensor(s) to the controller and a predetermined set-point temperature. For example, the predetermined set-point temperature may be a constant temperature defined by a user. In other embodiments, the predetermined set-point temperature may also vary in time, for example, according to a desired, user-defined temperature profile. For example, the temperature controller may be controlled manually by a user of the system or via a graphical user interface associated with the temperature controller.

Referring still to FIG. 2, in certain embodiments, the underground hydrocarbon reservoir 225 may be a carbonate reservoir. Common carbonate reservoirs have high temperatures (for example, in a range from approximately 50° C. to 200° C.) and high formation water salinities (for example, from approximately 30,000 ppm total dissolved solids, measured on a mass basis, to 250,000 ppm total dissolved solids). In certain embodiments, reservoir 225 is a sandstone reservoir. It should be understood that the systems and methods described in the present disclosure may be used for any type of hydrocarbon reservoir.

In certain embodiments, the conditions under which the carbonated injection 205 is prepared, introduced, or both (for example, conditions of temperature, pressure, and total concentration of one or more salts) and the properties of an underground reservoir (for example, the temperature, pressure, and formation water salinity of the reservoir) result in advantages for the systems and methods described in the present disclosure. For example, the high temperature (for example, of about 100° C. or greater) and high formation water salinity (for example, of about 250,000 ppm total dissolved solids) of an underground hydrocarbon reservoir may result in a local decrease in CO2 solubility inside the reservoir. This localized decrease in CO2 solubility may facilitate the release of dissolved CO2 gas from the carbonated injection 205 when it is inside the reservoir. Thus, dissolved CO2 may be preferentially released from the carbonated injection 205 inside the reservoir where it is most needed for improving oil recovery.

As shown in the illustrative example of FIG. 2, underground hydrocarbon reservoir 225 may be at an elevated temperature and salinity compared to the temperature and salinity of the carbonated injection 205 prepared in the vessel 210. The increase in the temperature and salinity of the carbonated injection 205 and the decrease in pressure upon introduction into reservoir 225 (depicted by the gradient 230 in the illustration of reservoir 225 and expansion towards the production well 275) may result in a localized decrease in the solubility of CO2. For example, CO2 solubility decreases with increasing temperature and increasing salinity. This decrease in CO2 solubility may facilitate, for example, the release of dissolved CO2 from the carbonated injection water. The released CO2 gas may mobilize remaining oil (for example, trapped oil ganglia) from reservoir 225, allowing for the recovery of otherwise inaccessible oil from the reservoir.

In the illustrative example of FIG. 2, the mobilized oil exits underground reservoir 225 through production well 275 at a production flow rate 270 along with at least a portion of the carbonated injection 205. In other embodiments, two or more production wells may be used to recover oil from reservoir 225. In still other embodiments, a single well may be used as the injection well and production well. For example, a volume of carbonated injection water may be introduced into the reservoir and flow may be stopped for an interval of time to maintain the carbonated injection water in the reservoir, as described previously. Following the period of time during which flow is stopped, the mobilized oil may be collected through the same well used for injection.

Underground hydrocarbon reservoir 225 may have an increased formation water salinity (for example, from about 30,000 ppm to about 250,000 ppm total dissolved solids). After being exposed to this high salinity formation water (for example, in reservoir 225), the salinity of the carbonated injection water may increase. FIG. 2 depicts an increase in salinity near the entrance to underground hydrocarbon reservoir 225 (for example, as the gradient 230 near the interface between reservoir 225 and injection well 215). For example, the salinity of a volume of carbonated injection water prepared in the vessel 210 may increase upon entering hydrocarbon reservoir 225.

In some embodiments, the injection flow rate 220 pushes carbonated water flooding of the underground hydrocarbon reservoir 225 as described above. The hydrocarbon reservoir 225 may help recovering hydrocarbons blobs in a trapped portion 285 by pushing the carbonated water. As the carbonated water propagates in the hydrocarbon reservoir 225 following propagation waves 235, the carbonated water is mixed with the hydrocarbon blobs. Further, a mixture 290 of the carbonated water and the hydrocarbon blobs may meet one or more rocks 280 before reaching the production well 275. In this process, the mixture 290 is pushed in between the rocks 280 in the direction of propagation lines 265 such that rocks 280 are a blockage portion 295, which may be the last portion of the underground hydrocarbon reservoir 225 to clear before recovering hydrocarbons from the underground hydrocarbon reservoir 225 in a transition 260 towards including the rocks 280.

In some embodiments, the trapped portion 285, the mixture 290, and the blockage portion 295 may be all combined in a same area of the underground hydrocarbon reservoir 225. A person of ordinary skill in the art would appreciate that the sequence of portions and propagation shown in FIG. 2 references the method and system for recovering hydrocarbons in sequence of the recovering workflow and is not uniquely based on a direction of the various flows illustrated in FIG. 2.

In some embodiments, the method and the system may identify indicators that reference a behavior of the hydrocarbon reservoir 225. These indicators may be based on characteristics inherent to the carbonated water, the trapped hydrocarbon blobs, the rocks 280, or the relations between these elements. For example, the characteristics may be a permeability of the carbonated water, a permeability of the trapped hydrocarbon blobs, and a permeability of the rocks 280 or a relative permeability of one element to another. In FIG. 2, by way of demonstration, the aforementioned permeability values may be represented by arrows that are proportional to a representative value of permeability. In this case, large permeability values are represented by larger arrows and small permeability values are represented by smaller arrows. The mixture 290 may include a permeability of carbonated water corresponding to a first arrow 240, a permeability of hydrocarbon blobs corresponding to a second arrow 255, a relative permeability of the carbonated water with respect to the hydrocarbon blob corresponding to a third arrow 245, and a relative permeability of the hydrocarbon blob with respect to the carbonated water corresponding to a fourth arrow 250. In some embodiments, permeability is the ability, or measurement of a rock's ability, to transmit fluids, typically measured in darcies or millidarcies. The term was basically defined by Henry Darcy, who showed that the common mathematics of heat transfer could be modified to adequately describe fluid flow in porous media. Formations that transmit fluids readily, such as sandstones, are described as permeable and tend to have many large, well-connected pores. Impermeable formations, such as shales and siltstones, tend to be finer grained or of a mixed grain size, with smaller, fewer, or less interconnected pores. Absolute permeability is the measurement of the permeability conducted when a single fluid, or phase, is present in the rock. Effective permeability is the ability to preferentially flow or transmit a particular fluid through a rock when other immiscible fluids are present in the reservoir (for example, effective permeability of gas in a gas-water reservoir). The relative saturations of the fluids as well as the nature of the reservoir affect the effective permeability. Relative permeability is the ratio of effective permeability of a particular fluid at a particular saturation to absolute permeability of that fluid at total saturation. If a single fluid is present in a rock, its relative permeability is 1.0. Calculation of relative permeability allows for comparison of the different abilities of fluids to flow in the presence of each other, since the presence of more than one fluid generally inhibits flow.

Figure 3A:
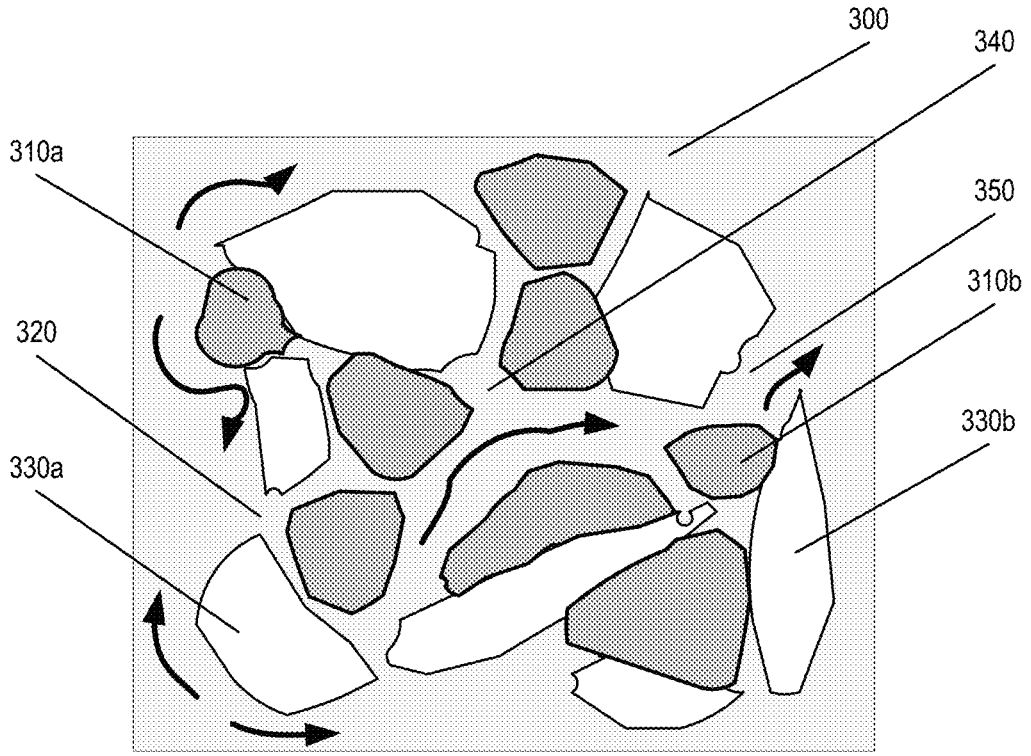
FIGS. 3A and 3B show examples in accordance with one or more embodiments.
Figure 3B:
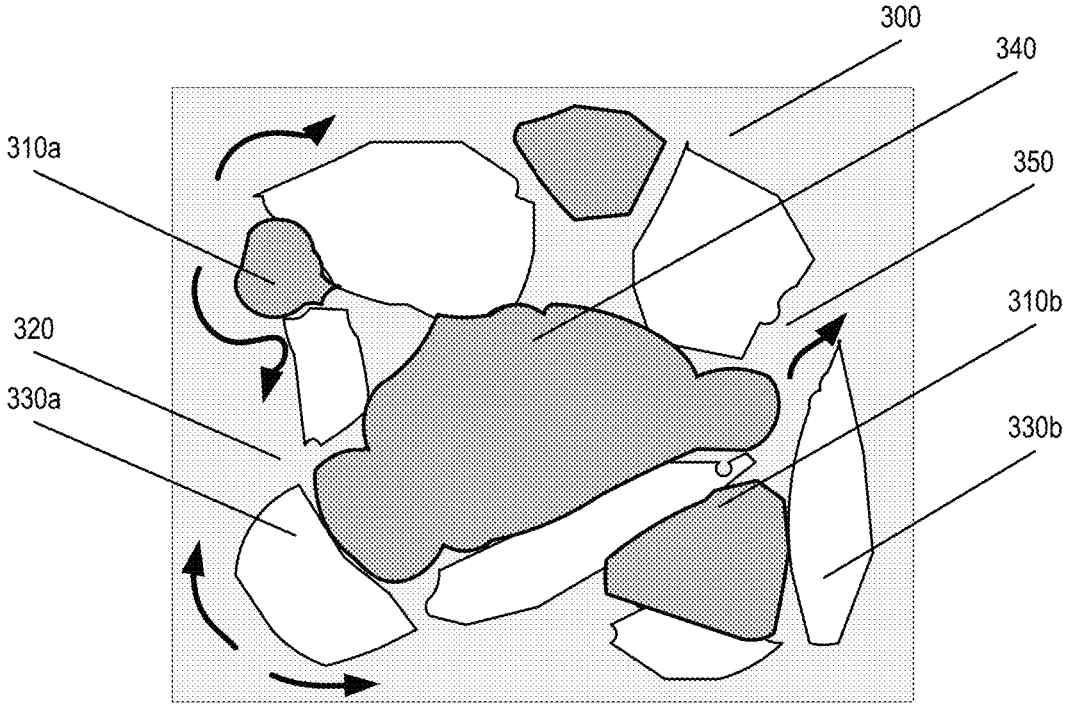

FIGS. 3A and 3B show microscopic pore-scale distribution of oil and brine (i.e., water containing more dissolved inorganic salt than typical seawater) for stable water films with large surface viscosity and coalesced oil droplets with less surface viscosity, respectively. As mentioned above, methodology, models, and workflows for predicting hydrocarbon recovery from subterranean formations are described. In FIGS. 3A and 3B, the method and the system identify fluid-fluid interface interactions during transport phenomenon relevant to advanced waterflooding processes. In FIGS. 3A and 3B, the method and the system show the relation followed to identify an interpolating parameter that represents the fluid-fluid interactions in the subterranean formation when the brine chemistry used in waterflooding differs from the existing brine chemistry in subterranean formation.

In some embodiments, while the waterflooding process is one of the most applied and successful oil recovery methods in the petroleum industry, the fundamental mechanisms associated with such a recovery method are still not fully understood. There is a complex interaction of various forces such as gravity, viscous, capillary, reactive, and electrokinetic forces occurring at the microscopic scale. Such microscopic forces take place in fluid bulks, fluid-fluid interface, and fluid-rock interface, which dictate the overall brine and oil distributions during the waterflooding process at the kilometer reservoir scale. In some embodiments, the method and the system include fluid-fluid interactions as a parameter for modeling hydrocarbon recovery and pressure drop prediction. Specifically, surface viscosity of a fluid-fluid interface may be used as an input to a relative permeability curve in a multiphase Darcy model. In this regard, the multiphase Darcy law is written as follows:

$$Q_i = A\frac{kk_{ri}}{\mu_i}\frac{\partial p}{\partial x}, \tag{1}$$

where $Q_i$ is the corresponding fluid phase (crude oil or brine) flow rate, A is the rock sample cross-section, k is the absolute permeability, $\mu_i$ is the fluid viscosity, $k_{ri}$ is the relative permeability of the corresponding fluid phase, and $$\frac{\partial p}{\partial x}$$

is the applied pressure gradient. In some embodiments, various experiments have concluded that fluid-fluid interactions strongly affect the crude oil coalescence surrounded by brine with a specific chemistry. Studies on the effect of individual ions on the surface viscosity and elasticity show that sulfates ($SO_4^{-2}$) increase the coalescence time between two oil-droplets due to increase in the surface viscosity of sulfate rich brine/crude oil.

In FIGS. 3A and 3B, an increase in coalescence time indicates that smaller disconnected oil blobs 310*a* and 310*b* surrounded by stable connected water films 340 are likely to occur inside the rock pore-space 300, as illustrated by entry point 320 on FIG. 3A. Certain brine chemistries surrounding the crude oil have shorter time-scale of oil coalescence meaning that the oil blobs 310*a* and 310*b* are more likely to be connected inside the reservoir at the microscopic level, which is illustrated by exit point 350 on FIG. 3A. Coalesced and connected oil blobs 310*a* and 310*b* inside the reservoir is the preferred scenario, because viscous forces become larger as the length of the blob (L in FIG. 3A) increases. The trapped oil inside the rock pores 330*a* and 330*b* due to capillary forces starts to mobilize and be displaced by the injected brine once the viscous pressure drop $\Delta p_m$ overtakes the capillary pressure $p_{cap}$. Mathematically, this condition may be expressed as follows:

$$\Delta p_m = \frac{Lu\mu_w}{k} > P_{cap} = 2\sigma\cos\theta\left(\frac{1}{r_{th}} - \frac{1}{r_b}\right), \tag{2}$$

where L is the oil-blob length, u is the brine velocity, $\mu_w$ is the brine viscosity, a is the interfacial-tension, θ is the contact-angle, $r_{th}$ is the pore-throat radius, and $r_b$ is the pore-body radius. As L increases due to coalescence, the viscous forces increase and may become greater than the capillary forces for some regions of the reservoir. Therefore, there is a correlation between residual oil inside the reservoir and the surface viscosity of the crude oil/brine interface. The macroscopic multiphase flow Darcy may include the residual oil as a parameter in the capillary pressure and relative permeability curves. FIG. 3B shows the workflow of the method and system taking the fluid-fluid interface viscosity into consideration, which includes L expanding by integrating nearby oil blobs. The pressure and saturation equations (Multiphase Darcy model) may be solved first. Based on the computed Darcy velocities, ion concentrations may be transported based on the water velocity. Then, a dynamic local brine-salinity values may be used for determining the surface-viscosity of the fluid-fluid altering the relative permeability curves. This coupling between the multiphase flow, ion transport, and fluid-fluid surface-viscosity parameter is maintained during production of the model.

Figure 4:
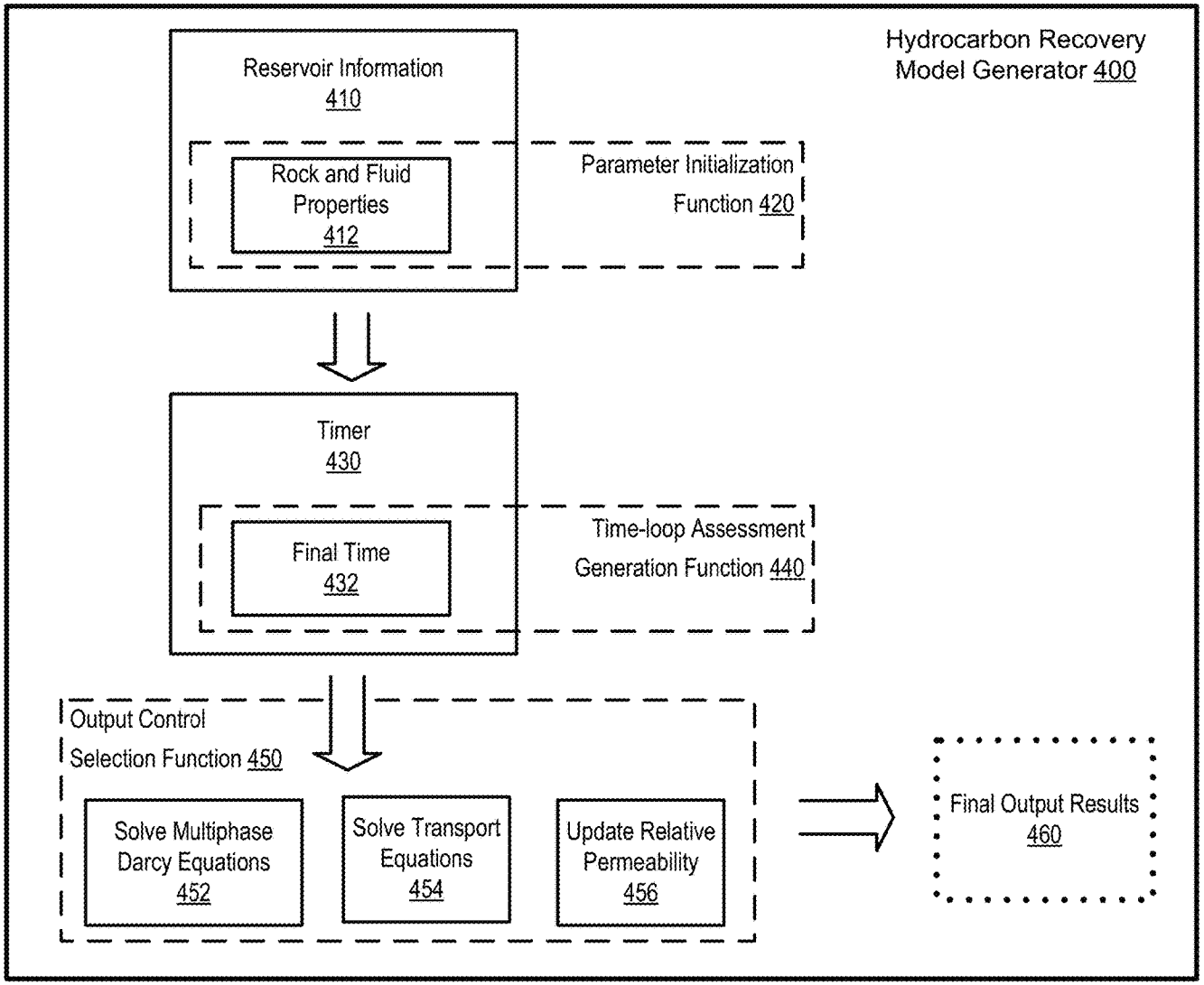
FIG. 4 shows a processing example in accordance with one or more embodiments.

FIG. 4 illustrates a successive flow of parameters implemented in generating the hydrocarbon recovery model by a hydrocarbon recovery model generator 400. In FIG. 4, the hydrocarbon recovery model generator 400 may be implemented by one or more devices described in reference to numeral 105 of FIG. 1, in reference to the injection well 215 or the production well 275 of FIG. 2, or in reference to the computer system 800 of FIG. 8A. in some embodiments, the hydrocarbon recovery model generator 400 identifies reservoir information 410 (i.e., stimulation data or reservoir data) including rock and fluid properties 412 for using in a parameter initialization function 420 of an area of interest. The area of interest is any reservoir or section of a reservoir in which hydrocarbon recovery may be implemented. In some embodiments, the method and the system generate a hydrocarbon retrieving model incorporating rock and fluid properties 412 such as surface viscosity. In some embodiments, the reservoir information 410 may include one or more parameters described in reference to Tables 1-4 below.

Table 1 shows salinities of some brines as well as their corresponding surface dynamic viscosities. Table 2 shows the crude oil properties, and Table 3 lists the carbonate rock sample properties. Table 4 lists the fluids and injection parameters used in the simulation results.

TABLE 1

| | Brine samples (concentration ppm) | |
|---|---|---|
| Ions | Brine 1 | Brine 2 |
| $Na^+$ | 1865 | 1824 |
| $Cl^-$ | — | 3220 |
| $Ca^{+2}$ | — | 65 |
| $Mg^{+2}$ | — | 211 |
| $SO_4^{-2}$ | 3896 | 429 |
| Total dissolved Solids (TDS) | 5750 | 5750 |
| Surface dynamic viscosity (Pa · s · m) | 0.025 | 0.0075 |

TABLE 2

| API | 34 |
|---|---|
| Acid number (mg KOH/g) | 0.71 |
| Base number (mg KOH/g) | 0.06 |
| Asphaltenes (%) | 5.4 |

TABLE 3

| Rock Sample | Carbonate |
|---|---|
| Diameter (cm) | 3.4 |
| Length (cm) | 23.7 |
| Total porosity (%) | 24.7 |
| Permeability (mD) | 68.3 |

TABLE 4

| flow rate (cc/min) | Viscosity $\mu_{oil}/\mu_{wat}$ (cP) | Interfacial Tension σ (N/m) | Density $\rho_{oil}/\rho_{wat}$ (kg/m$^3$) |
|---|---|---|---|
| 1 | 1/6 | 0.022 | 1000/800 |

In the parameter initialization function 420, the parameters associated with the model are selected based on their relevance. For example, if Brine 1 (from Table 1) is injected for 15 PV, which has relatively higher surface-viscosity (0.025 Pa·s·m) due to higher concentration of sulfates ($SO_4^{-2}$), the corresponding residual oil is 0.1, which may be taken into account in a relative permeability curve. The injection rate may be increased to 4 cc/min to ensure the residual oil may be reached, similar to a typical experimental procedure. After 15 PV, Brine 2 may be injected as a Smart Water recipe. The surface-viscosity then is 0.0075, which is about three-times less than Brine 1 surface-viscosity with the same crude oil. In Brine 2, the oil blobs (such as 310*a* and 310*b* shown in FIGS. 3A and 3B) are more connected and their length increases, which statistically means the residual oil is more likely to be less for the same rock sample and injection parameters. In this case, we input the residual oil value to be 0.0065, which has resulted in a slight increase in oil recovery (about 4%).

The parameter initialization function 420 may share processing with a time-loop assessment generation function 440, which controls a timer 430 indicating a final time 432 in which an iterative loop is to be stopped. The iterative loop being a representation of the repetitive process of evaluating subsequent parameters based on transport calculations and the multiphase Darcy equations until the final time 432 of the iterations is reached. The final time 432 may be controlled by hardware or software of the hydrocarbon recovery model generator 400.

Once the timer 430 with the final time 432 are set, an output control selection function 450 may perform processing of the initialized parameters to solve multiphase Darcy equations 452, solve transport equations 454, and update relative permeability 456 during mixing such that final output results 460 may be used for modeling the hydrocarbon recovery workflow.

Specifically, in some embodiments, if mixing occurs between two different brine chemistries and needs to be captured, the salinity of the brine can locally acquire an intermediate salinity-level. In this scenario, a linear interpolating parameter is used to determine the intermediate relative permeability values as follows $$k_{rw}=(1-\theta_{ff})k_{rw}^{C}+\theta_{ff}k_{rw}^{e}, \tag{3}$$

$$k_{ro}=(1-\theta_{ff})k_{ro}^{C}+\theta_{ff}k_{ro}^{e}, \tag{4}$$

where $\theta_{ff}$ is the interpolating parameter corresponding to the intermediate fluid-fluid surface viscosity as follows:

$$\theta_{rr}=\frac{\mu_{s,x}-\mu_{s,min}}{\mu_{s,max}-\mu_{s,min}}, \tag{5}$$

where, $\mu_{s,x}$ is the surface-viscosity of crude oil/brine at an intermediate salinity-level, $\mu_{s,min}$ is the surface-viscosity of crude oil brine with the smallest magnitude, and $\mu_{s,max}$ is the surface-viscosity of crude oil brine recipe having a larger magnitude. $\mu_{s,x}$ may be determined either by taking the weighted average of $\mu_{s,min}$ and $\mu_{s,max}$ based on the local salinity-value, or can be correlated with the local concentration of individual ions if large bank of surface-viscosity data is acquired in the lab with respect to various brine chemistries. The latter approach may be more accurate since it captures the true value of the fluid-fluid surface-viscosity.

In some embodiments, the hydrocarbon recovery model generator 400 may provide the possibility to conduct a sensitivity analysis to study the effect of fluid-fluid interactions that may further enhance and increase oil recovery in a systematic and more robust approach. Additional experimental data to study the effect of fluid-fluid interaction during multiphase flow may be required to validate the any subsequent models. In this regard, the modeling framework described in reference to FIGS. 1-4 incorporates details of fluid-fluid interactions relevant advanced waterflooding as well as EOR processes. The detailed and accurate effects of fluid-fluid interactions require information about the crude oil distribution at the pore-scale (i.e., reservoir information 410 including crude oil blob size, interfacial area, and connectivity), which is the most challenging part to predict. In this regard, the hydrocarbon recovery model generator 400 includes dynamically implementing assumptions regarding the crude oil residual characteristics at the pore-scale. As described above, in some embodiments, hydrocarbon recovery model generator 400 may include the brine chemistry effect on fluid-fluid rheology during advanced waterflooding in subterranean reservoirs such that the final output results 460 are representative of a methodology that incorporates such rheological effects, which improve the model robustness and contribute in improving the oil recovery process.

Figure 5:
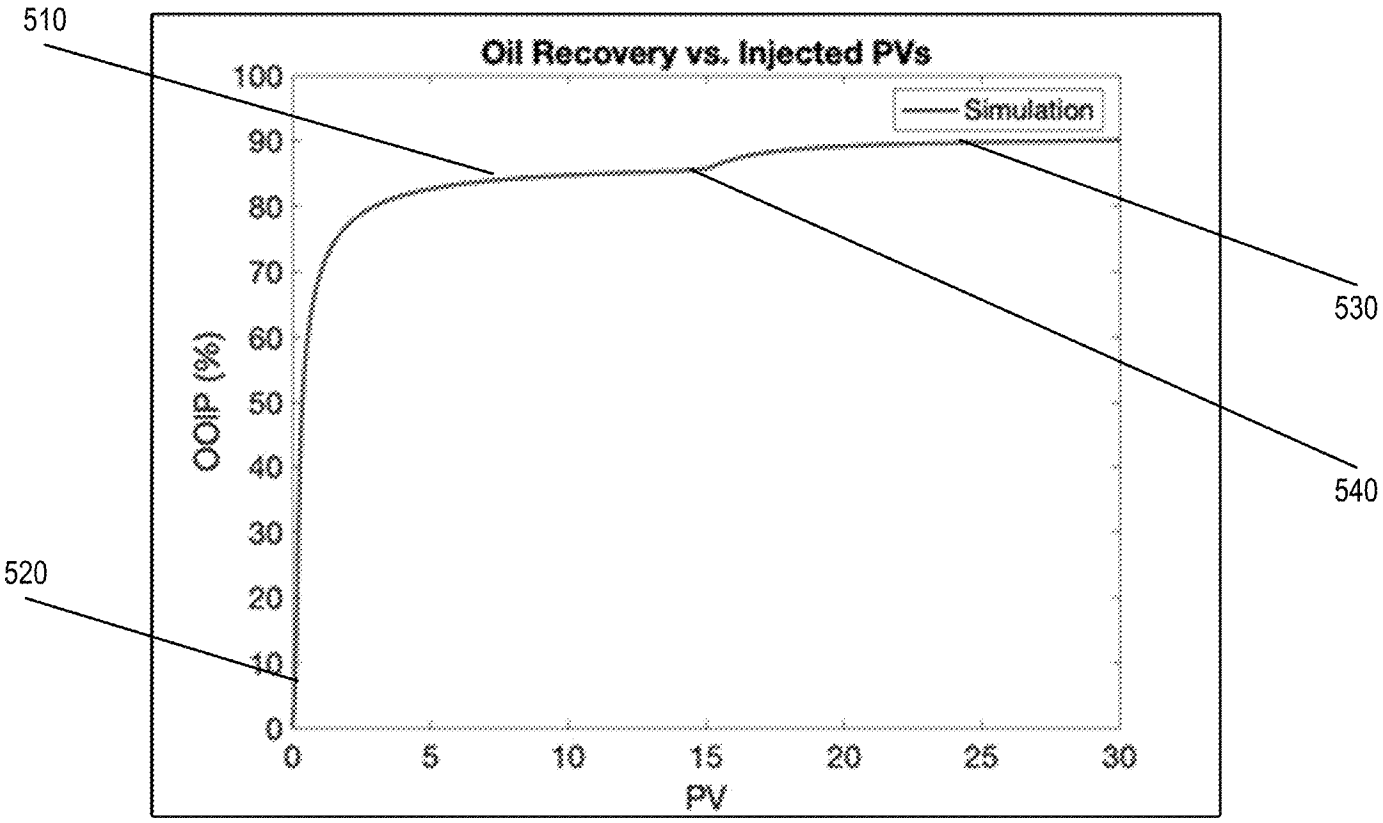
FIG. 5 shows a graph in accordance with one or more embodiments.

FIG. 5 illustrates original oil in place percentage (OOIP %) against injected pore-volumes (PV) for a considered subterranean carbonate rock sample. Curve 530 represents the simulation results from multiphase Darcy, where the brine chemistry is changed at 15 PV. In this case, the oil recovery is shown as increasing logarithmically as injected PV increases. The rate of change is high as the injected PV increase. An initial rate of change 520 (near 0 injected PVs) is shown as almost immediately changing the OOIP %. The rate of change continues increasing from 0 injected PVs to about 5 injected PVs where the curve 530 reaches a semi-plateau 510 with a low rate of change. At this point, the only significant change in the OOIP % may be seen at injecting 15 PVs, at which point the model has been implemented including the second brine chemistry.

Figure 6:
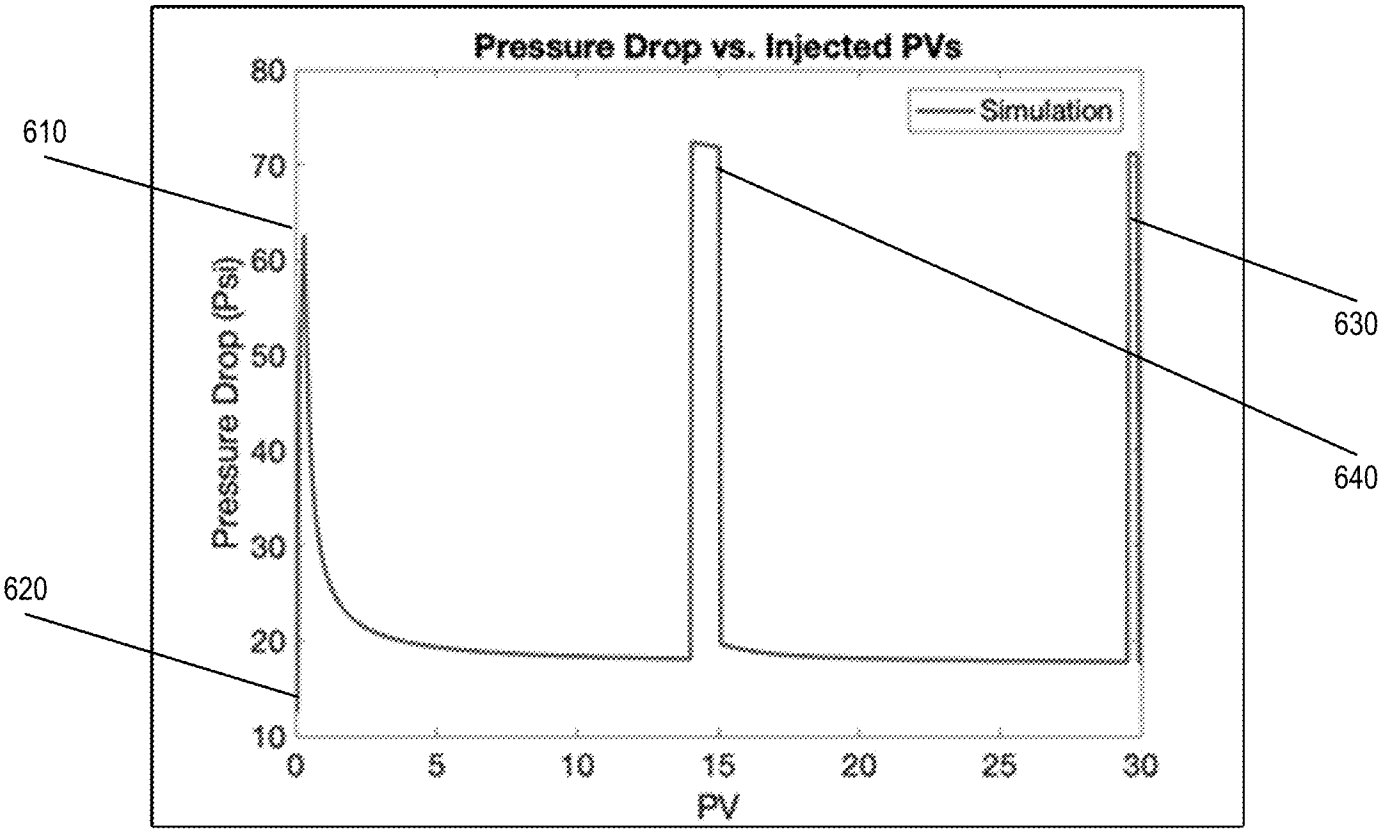
FIG. 6 shows a graph in accordance with one or more embodiments.

FIG. 6 illustrates the pressure drop in Psi vs. injected pore-volumes (PV) for the considered subterranean carbonate rock sample. Curve 630 represents the simulation results from multiphase Darcy, where the brine chemistry is changed at 15 PV. Following the analysis of FIG. 5, an initial rate of change 620 increases drastically until it reaches an initial local maximum 610. Further, the pressure drop does not increase until the brine chemistry is changes at 15 injected PVs.

Figure 7:
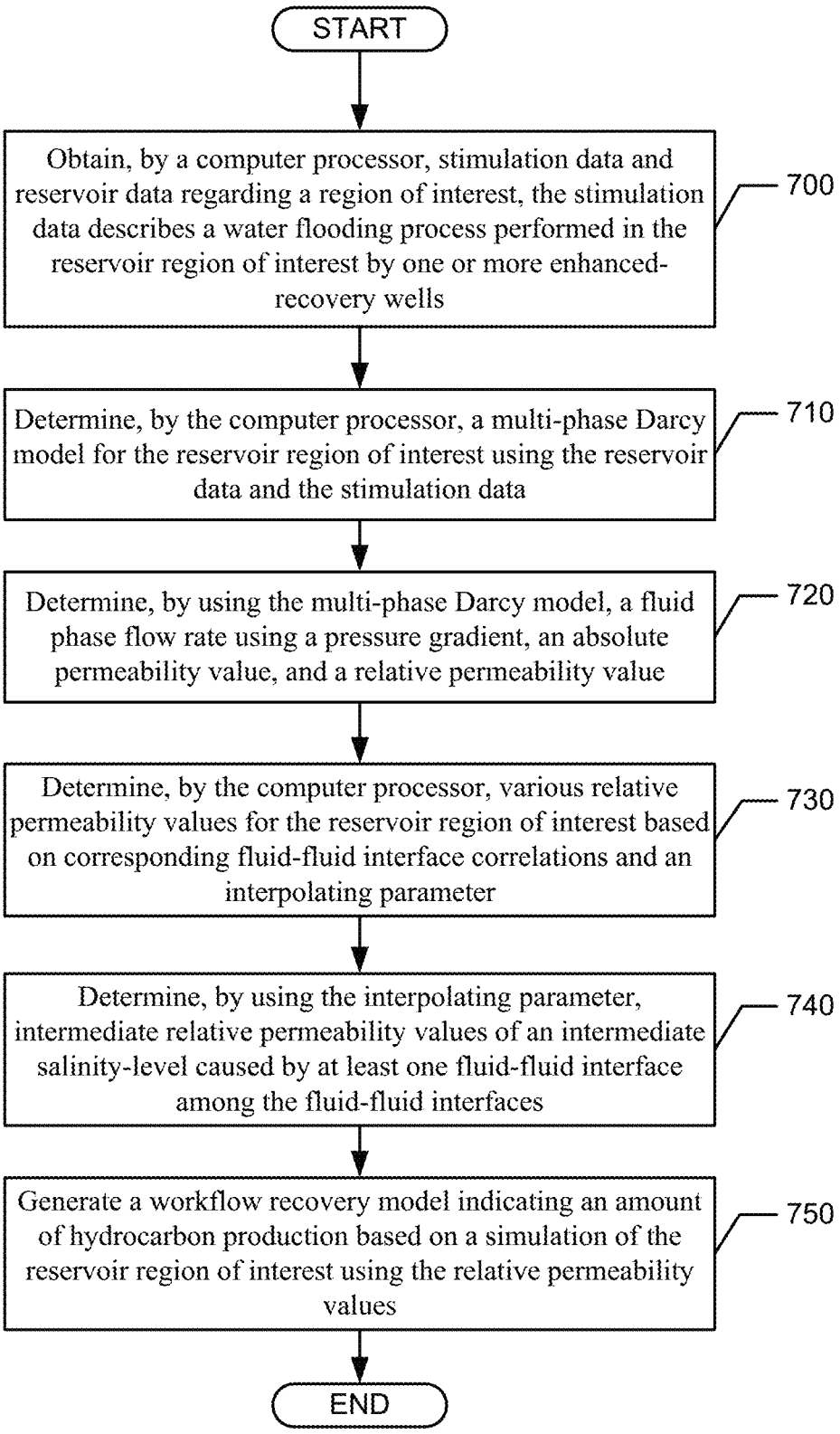
FIG. 7 shows a flowchart in accordance with one or more embodiments.

FIG. 7 shows a flowchart in accordance with one or more embodiments. Specifically, FIG. 7 describes a method for modeling hydrocarbon recovery workflow. One or more blocks in FIG. 7 may be performed by one or more components as described above in FIGS. 1-3 (e.g., reservoir simulator 132), one of ordinary skill in the art will appreciate that some or all of the blocks may be executed in a different order, may be combined or omitted, and some or all of the blocks may be executed in parallel. Furthermore, the blocks may be performed actively or passively.

In Block 700, a computer processor obtains stimulation data and reservoir data regarding a region of interest, wherein the stimulation data describe a waterflooding process performed in the reservoir region of interest by one or more production enhanced-recovery wells. The data may include rock and fluid properties as those discussed with respect to FIG. 4.

In Block 710, the computer processor determines a multiphase Darcy model for the reservoir region of interest using the reservoir data and the stimulation data. This may include solving pressure and multiphase Darcy equations to determine the velocity using a non-linear solver algorithm for convergence.

In Block 720, the multi-phase Darcy model determines a fluid phase flow rate using a pressure gradient, an absolute permeability value, and a relative permeability value. This determination may provide support for finding ion concentrations by solving ion transport equations using the velocity from Block 710 to solve another set of non-linear equations using a similar algorithm to find converged solution.

In Block 730, the computer processor determines a plurality of relative permeability values for the reservoir region of interest based on a plurality of fluid-fluid interface correlations and an interpolating parameter. These permeability values may be updated based on fluid-fluid interface viscosity correlation with ion concentration.

In Block 740, the interpolating parameter determines intermediate relative permeability values of an intermediate salinity-level caused by at least one fluid-fluid interface among the plurality of fluid-fluid interfaces following the hydrocarbon recovery workflow models described in reference to FIGS. 1-6. The hydrocarbon recovery workflow models may follow a subterranean advanced waterflooding simulation framework consisting of detailed fluid-fluid interactions as an input parameter in a macroscale model, and an effect of brine salinity on fluid-fluid rheological properties through an interpolating parameter macroscale transport models for fluid flow across a subterranean rock sample. As described above, the fluids may be water, oil, gas, or any type of injected fluids such as chemicals in subterranean porous formations. Rocks may be sandstone, or carbonate formations.

In Block 750, a workflow recovery model is generated indicating an amount of hydrocarbon production based on a simulation of the reservoir region of interest using the relative permeability values. As described in reference to FIGS. 1-6, the hydrocarbon recovery workflow models include a transport model with fluid-fluid interfacial interactions through an input parameter encapsulating fluid-fluid rheology. In this regard, the hydrocarbon recovery workflow models support the aim of optimizing injected waterflooding parameters to increase oil recovery from reservoirs.

In some embodiments, the hydrocarbon recovery workflow models may be used as a screening process to design the injected water chemistry, and may accurately improve hydrocarbon recovery compared to current practices of using seawater or aquifer water injection. As stated, the hydrocarbon recovery workflow models help to define the optimal injected water chemistry parameters (based on the additional fluid-fluid physicochemical interactions parameter) suitable for various reservoir fields. The macroscopic scale model in the hydrocarbon recovery workflow models include input parameters that have experimental values of interfacial rheology measured in lab.

Figure 8A:
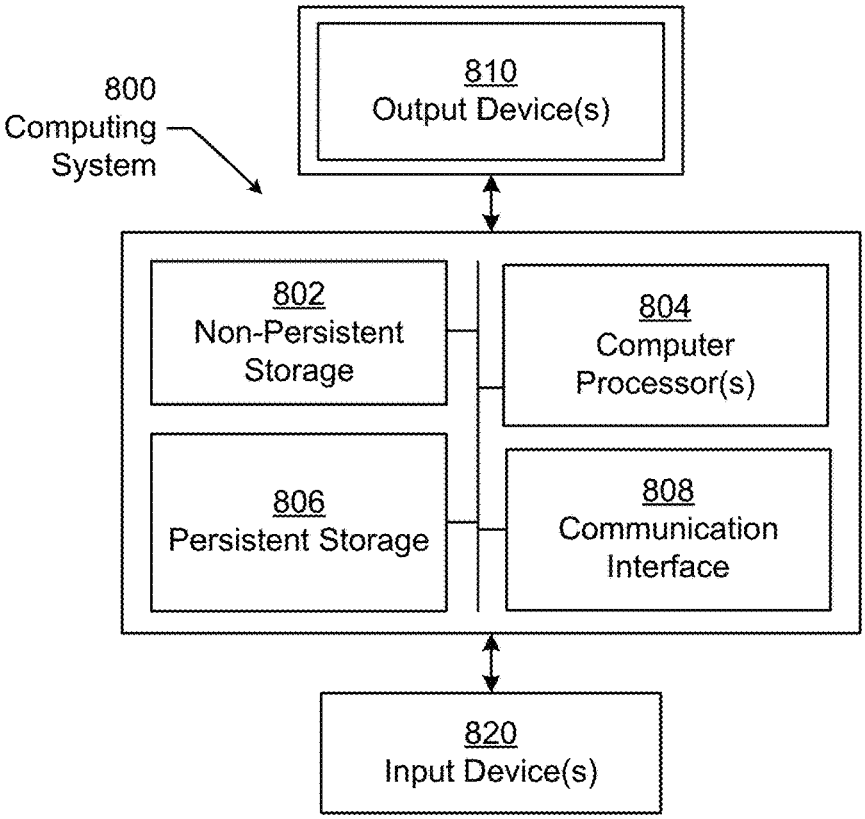
FIGS. 8A and 8B show a computer system and a network system in accordance with one or more embodiments.

Embodiments of the invention may be implemented on virtually any type of computing system, regardless of the platform being used. For example, the computing system may be one or more mobile devices (e.g., laptop computer, smart phone, personal digital assistant, tablet computer, or other mobile device), desktop computers, servers, blades in a server chassis, or any other type of computing device or devices that includes at least the minimum processing power, memory, and input and output device(s) to perform one or more embodiments of the invention. For example, as shown in FIG. 8A, the computing system 600 may include one or more computer processor(s) 804, non-persistent storage 802 (e.g., random access memory (RAM), cache memory, flash memory, etc.), one or more persistent storage 806 (e.g., a hard disk, an optical drive such as a compact disk (CD) drive or digital versatile disk (DVD) drive, a flash memory stick, etc.), and numerous other elements and functionalities. The computer processor(s) 804 may be an integrated circuit for processing instructions. For example, the computer processor(s) 804 may be one or more cores, or micro-cores of a processor. The computing system 800 may also include one or more input device(s) 820, such as a touchscreen, keyboard, mouse, microphone, touchpad, electronic pen, or any other type of input device. Further, the computing system 800 may include one or more output device(s) 810, such as a screen (e.g., a liquid crystal display (LCD), a plasma display, touchscreen, cathode ray tube (CRT) monitor, projector, or other display device), a printer, external storage, or any other output device. One or more of the output device(s) may be the same or different from the input device(s). The computing system 800 may be connected to a network system 830 (e.g., a local area network (LAN), a wide area network (WAN) such as the Internet, mobile network, or any other type of network) via a network interface connection (not shown). Many different types of computing systems exist, and the aforementioned input and output device(s) may take other forms.

Software instructions in the form of computer readable program code to perform embodiments of the invention may be stored, in whole or in part, temporarily or permanently, on a non-transitory computer readable medium such as a CD, DVD, storage device, a diskette, a tape, flash memory, physical memory, or any other computer readable storage medium. Specifically, the software instructions may correspond to computer readable program code that when executed by a processor(s), is configured to perform embodiments of the invention.

Further, one or more elements of the aforementioned computing system 800 may be located at a remote location and be connected to the other elements over a network system 830. Further, one or more embodiments of the invention may be implemented on a distributed system having various nodes, where each portion of the invention may be located on a different node within the distributed system. In one embodiment of the invention, the node corresponds to a distinct computing device. Alternatively, the node may correspond to a computer processor with associated physical memory. The node may alternatively correspond to a computer processor or micro-core of a computer processor with shared memory and/or resources.

Figure 8B:
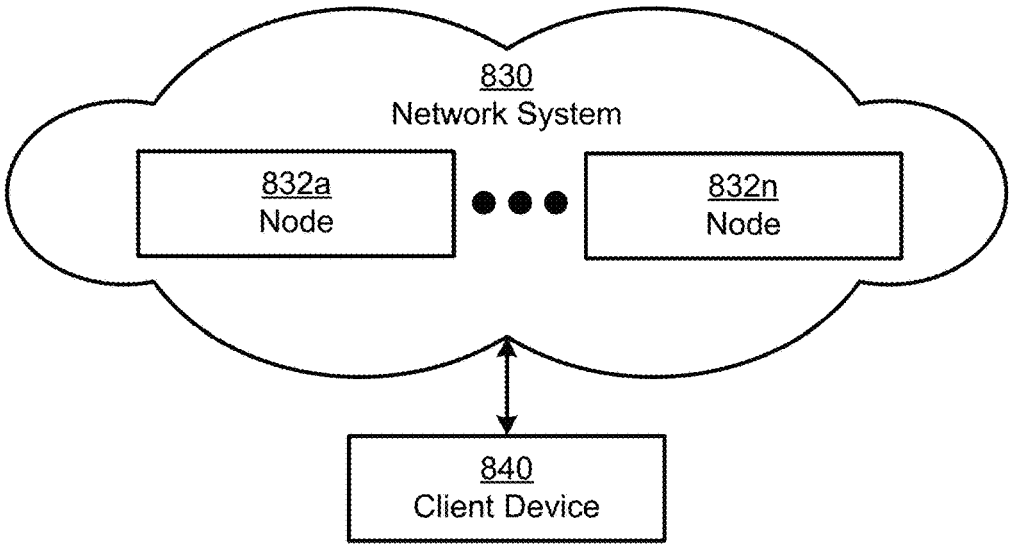

The computing system 800 in FIG. 8A may be connected to or be a part of a network. For example, as shown in FIG. 8B, the network system 830 may include multiple nodes (e.g., node 832*a* to node 834*n*). Each node may correspond to a computing system, such as the computing system shown in FIG. 8A, or a group of nodes combined may correspond to the computing system shown in FIG. 8A. By way of an example, embodiments of the disclosure may be implemented on a node of a distributed system that is connected to other nodes. By way of another example, embodiments of the disclosure may be implemented on a distributed computing system having multiple nodes, where each portion of the disclosure may be located on a different node within the distributed computing system. Further, one or more elements of the aforementioned computing system 800 may be located at a remote location and connected to the other elements over a network. As such, the aforementioned computing system 800 may be connected through a remote connection established using a 5G connection, such as a protocols established in Release 15 and subsequent releases of the 3GPP/New Radio (NR) standards.

Although not shown in FIG. 8B, the node may correspond to a blade in a server chassis that is connected to other nodes via a backplane. By way of another example, the node may correspond to a server in a data center. By way of another example, the node may correspond to a computer processor or micro-core of a computer processor with shared memory and/or resources.

The nodes (e.g., node 832*a* to node 834*n*) in the network system 830 may be configured to provide services for a client device 840. For example, the nodes may be part of a cloud computing system, such as the reservoir simulator 132 described in FIGS. 1-3. The nodes may include functionality to receive requests from the client device 840 and transmit responses to the client device 840. The client device 840 may be a computing system 800, such as the computing system 800 shown in FIG. 8A. Further, the client device 840 may include and/or perform all or a portion of one or more embodiments of the disclosure.

The computing system or group of computing systems described in FIGS. 8A and 8B may include functionality to perform a variety of operations disclosed herein. For example, the computing system(s) may perform communication between processes on the same or different systems. A variety of mechanisms, employing some form of active or passive communication, may facilitate the exchange of data between processes on the same device. Examples representative of these inter-process communications include, but are not limited to, the implementation of a file, a signal, a socket, a message queue, a pipeline, a semaphore, shared memory, message passing, and a memory-mapped file. Further details pertaining to a couple of these non-limiting examples are provided below.

Based on the client-server networking model, sockets may serve as interfaces or communication channel endpoints enabling bidirectional data transfer between processes on the same device. Foremost, following the client-server networking model, a server process (e.g., a process that provides data) may create a first socket object. Next, the server process binds the first socket object, thereby associating the first socket object with a unique name and/or address. After creating and binding the first socket object, the server process then waits and listens for incoming connection requests from one or more client processes (e.g., processes that seek data). At this point, when a client process wishes to obtain data from a server process, the client process starts by creating a second socket object. The client process then proceeds to generate a connection request that includes at least the second socket object and the unique name and/or address associated with the first socket object. The client process then transmits the connection request to the server process. Depending on availability, the server process may accept the connection request, establishing a communication channel with the client process, or the server process, busy in handling other operations, may queue the connection request in a buffer until the server process is ready. An established connection informs the client process that communications may commence. In response, the client process may generate a data request specifying the data that the client process wishes to obtain. The data request is subsequently transmitted to the server process. Upon receiving the data request, the server process analyzes the request and gathers the requested data. Finally, the server process then generates a reply including at least the requested data and transmits the reply to the client process. The data may be transferred, more commonly, as datagrams or a stream of characters (e.g., bytes).

Shared memory refers to the allocation of virtual memory space in order to substantiate a mechanism for which data may be communicated and/or accessed by multiple processes. In implementing shared memory, an initializing process first creates a shareable segment in persistent or non-persistent storage. Post creation, the initializing process then mounts the shareable segment, subsequently mapping the shareable segment into the address space associated with the initializing process. Following the mounting, the initializing process proceeds to identify and grant access permission to one or more authorized processes that may also write and read data to and from the shareable segment. Changes made to the data in the shareable segment by one process may immediately affect other processes, which are also linked to the shareable segment. Further, when one of the authorized processes accesses the shareable segment, the shareable segment maps to the address space of that authorized process. Often, one authorized process may mount the shareable segment, other than the initializing process, at any given time.

Other techniques may be used to share data, such as the various data described in the present application, between processes without departing from the scope of the disclosure. The processes may be part of the same or different application and may execute on the same or different computing system.

Rather than or in addition to sharing data between processes, the computing system performing one or more embodiments of the disclosure may include functionality to receive data from a user. For example, in one or more embodiments, a user may submit data via a graphical user interface (GUI) on the user device. Data may be submitted via the graphical user interface by a user selecting one or more graphical user interface widgets or inserting text and other data into graphical user interface widgets using a touchpad, a keyboard, a mouse, or any other input device. In response to selecting a particular item, information regarding the particular item may be obtained from persistent or non-persistent storage by the computer processor. Upon selection of the item by the user, the contents of the obtained data regarding the particular item may be displayed on the user device in response to the user's selection.

By way of another example, a request to obtain data regarding the particular item may be sent to a server operatively connected to the user device through a network. For example, the user may select a uniform resource locator (URL) link within a web client of the user device, thereby initiating a Hypertext Transfer Protocol (HTTP) or other protocol request being sent to the network host associated with the URL. In response to the request, the server may extract the data regarding the particular selected item and send the data to the device that initiated the request. Once the user device has received the data regarding the particular item, the contents of the received data regarding the particular item may be displayed on the user device in response to the user's selection. Further to the above example, the data received from the server after selecting the URL link may provide a web page in Hyper Text Markup Language (HTML) that may be rendered by the web client and displayed on the user device.

Once data is obtained, such as by using techniques described above or from storage, the computing system, in performing one or more embodiments of the disclosure, may extract one or more data items from the obtained data. For example, the extraction may be performed as follows by the computing system 800 in FIG. 8A. First, the organizing pattern (e.g., grammar, schema, layout) of the data is determined, which may be based on one or more of the following: position (e.g., bit or column position, Nth token in a data stream, etc.), attribute (where the attribute is associated with one or more values), or a hierarchical/tree structure (consisting of layers of nodes at different levels of detail—such as in nested packet headers or nested document sections). Then, the raw, unprocessed stream of data symbols is parsed, in the context of the organizing pattern, into a stream (or layered structure) of tokens (where each token may have an associated token "type").

Next, extraction criteria are used to extract one or more data items from the token stream or structure, where the extraction criteria are processed according to the organizing pattern to extract one or more tokens (or nodes from a layered structure). For position-based data, the token(s) at the position(s) identified by the extraction criteria are extracted. For attribute/value-based data, the token(s) and/or node(s) associated with the attribute(s) satisfying the extraction criteria are extracted. For hierarchical/layered data, the token(s) associated with the node(s) matching the extraction criteria are extracted. The extraction criteria may be as simple as an identifier string or may be a query presented to a structured data repository (where the data repository may be organized according to a database schema or data format, such as XML).

The extracted data may be used for further processing by the computing system. For example, the computing system of FIG. 8A, while performing one or more embodiments of the disclosure, may perform data comparison. Data comparison may be used to compare two or more data values (e.g., A, B). For example, one or more embodiments may determine whether A>B, A=B, A!=B, A<B, etc. The comparison may be performed by submitting A, B, and an opcode specifying an operation related to the comparison into an arithmetic logic unit (ALU) (i.e., circuitry that performs arithmetic and/or bitwise logical operations on the two data values). The ALU outputs the numerical result of the operation and/or one or more status flags related to the numerical result. For example, the status flags may indicate whether the numerical result is a positive number, a negative number, zero, etc. By selecting the proper opcode and then reading the numerical results and/or status flags, the comparison may be executed. For example, in order to determine if A>B, B may be subtracted from A (i.e., A−B), and the status flags may be read to determine if the result is positive (i.e., if A>B, then A−B>0). In one or more embodiments, B may be considered a threshold, and A is deemed to satisfy the threshold if A=B or if A>B, as determined using the ALU. In one or more embodiments of the disclosure, A and B may be vectors, and comparing A with B includes comparing the first element of vector A with the first element of vector B, the second element of vector A with the second element of vector B, etc. In one or more embodiments, if A and B are strings, the binary values of the strings may be compared.

The computing system in FIG. 8A may implement and/or be connected to a data repository. For example, one type of data repository is a database. A database is a collection of information configured for ease of data retrieval, modification, re-organization, and deletion. Database Management System (DBMS) is a software application that provides an interface for users to define, create, query, update, or administer databases.

The user, or software application, may submit a statement or query into the DBMS. Then the DBMS interprets the statement. The statement may be a select statement to request information, update statement, create statement, delete statement, etc. Moreover, the statement may include parameters that specify data, or data container (database, table, record, column, view, etc.), identifier(s), conditions (comparison operators), functions (e.g. join, full join, count, average, etc.), sort (e.g. ascending, descending), or others. The DBMS may execute the statement. For example, the DBMS may access a memory buffer, a reference or index a file for read, write, deletion, or any combination thereof, for responding to the statement. The DBMS may load the data from persistent or non-persistent storage and perform computations to respond to the query. The DBMS may return the result(s) to the user or software application.

The computing system of FIG. 8A may include functionality to present raw and/or processed data, such as results of comparisons and other processing. For example, presenting data may be accomplished through various presenting methods. Specifically, data may be presented through a user interface provided by a computing device. The user interface may include a GUI that displays information on a display device, such as a computer monitor or a touchscreen on a handheld computer device. The GUI may include various GUI widgets that organize what data is shown as well as how data is presented to a user. Furthermore, the GUI may present data directly to the user, e.g., data presented as actual data values through text, or rendered by the computing device into a visual representation of the data, such as through visualizing a data model.

For example, a GUI may first obtain a notification from a software application requesting that a particular data object be presented within the GUI. Next, the GUI may determine a data object type associated with the particular data object, e.g., by obtaining data from a data attribute within the data object that identifies the data object type. Then, the GUI may determine any rules designated for displaying that data object type, e.g., rules specified by a software framework for a data object class or according to any local parameters defined by the GUI for presenting that data object type. Finally, the GUI may obtain data values from the particular data object and render a visual representation of the data values within a display device according to the designated rules for that data object type.

Data may also be presented through various audio methods. In particular, data may be rendered into an audio format and presented as sound through one or more speakers operably connected to a computing device.

Data may also be presented to a user through haptic methods. For example, haptic methods may include vibrations or other physical signals generated by the computing system. For example, data may be presented to a user using a vibration generated by a handheld computer device with a predefined duration and intensity of the vibration to communicate the data.

The above description of functions presents only a few examples of functions performed by the computing system of FIG. 8A and the nodes and/or client device in FIG. 8B. Other functions may be performed using one or more embodiments of the disclosure.

While the disclosure has been described with respect to a limited number of embodiments, those skilled in the art, having benefit of this disclosure, will appreciate that other embodiments can be devised which do not depart from the scope of the disclosure as disclosed herein. Accordingly, the scope of the disclosure should be limited only by the attached claims.

What is claimed is:

1. A method comprising:

obtaining, by a computer processor, stimulation data and reservoir data regarding a region of interest, wherein the stimulation data describe a water flooding process performed in the reservoir region of interest by one or more enhanced-recovery wells;

determining, by the computer processor, a multi-phase Darcy model for the reservoir region of interest using the reservoir data and the stimulation data, wherein the multi-phase Darcy model determines a fluid phase flow rate using a pressure gradient, an absolute permeability value, and a relative permeability value;

determining, by the computer processor, a plurality of relative permeability values for the reservoir region of interest based on a plurality of fluid-fluid interface correlations and an interpolating parameter, wherein the interpolating parameter determines intermediate relative permeability values of an intermediate salinity-level caused by at least one fluid-fluid interface among the plurality of fluid-fluid interfaces;

determining an amount of hydrocarbon production based on a simulation of the reservoir region of interest using the plurality of relative permeability values;

determining, by the computer processor, a plurality of ion concentrations for the reservoir region of interest based on the plurality of fluid-fluid interface correlations and the interpolating parameter;

solving transport equations to determine the ion concentrations and relative permeability values; and updating the relative permeability values based on a fluid-fluid interface viscosity correlation with ion concentration.

2. The method of claim 1, further comprising:

generating a workflow recovery model indicating the amount of hydrocarbon production based on the simulation of the reservoir region of interest.

3. The method of claim 1, wherein the multi-phase Darcy model corresponds to equation:

$$Q_i = A\frac{kk_{ri}}{\mu_i}\frac{\partial p}{\partial x},$$

being a corresponding fluid phase flow rate, A being a rock sample cross-section, k being the absolute permeability value, $\mu_i$ being a fluid viscosity, $k_{ri}$ being the relative permeability vale, and $$\frac{\partial p}{\partial x}$$

being the applied pressure gradient.

4. The method of claim 1, further comprising:

determining a pressure drop within the reservoir region of interest using the simulation.

5. The method of claim 4, wherein the simulation of the reservoir region of interest is performed within an iterative time loop.

6. The method of claim 5, further comprising:

determining a stimulation plan based on the simulation of the reservoir region of interest over iterative time loop.

7. A computer system, comprising:

a processor; and a memory coupled to the processor, the memory comprising functionality for:

obtaining, by the processor, stimulation data and reservoir data regarding a region of interest, wherein the stimulation data describe a water flooding process performed in the reservoir region of interest by one or more enhanced-recovery wells;

determining, by the processor, a multi-phase Darcy model for the reservoir region of interest using the reservoir data and the stimulation data, wherein the multi-phase Darcy model determines a fluid phase flow rate using a pressure gradient, an absolute permeability value, and a relative permeability value;

determining, by the processor, a plurality of relative permeability values for the reservoir region of interest based on a plurality of fluid-fluid interface correlations and an interpolating parameter, wherein the interpolating parameter determines intermediate relative permeability values of an intermediate salinity-level caused by at least one fluid-fluid interface among the plurality of fluid-fluid interfaces;

determining an amount of hydrocarbon production based on a simulation of the reservoir region of interest using the plurality of relative permeability values;

determining, by the processor, a plurality of ion concentrations for the reservoir region of interest based on the plurality of fluid-fluid interface correlations and the interpolating parameter;

solving transport equations to determine the ion concentrations and relative permeability values; and updating the relative permeability values based on a fluid-fluid interface viscosity correlation with ion concentration.

8. The system of claim 7, wherein the memory further comprises functionality for:

generating a workflow recovery model indicating the amount of hydrocarbon production based on the simulation of the reservoir region of interest.

9. The system of claim 7, wherein the multi-phase Darcy model corresponds to equation:

$$Q_i = A\frac{kk_{ri}}{\mu_i}\frac{\partial p}{\partial x},$$

$Q_1$ being a corresponding fluid phase flow rate, A being a rock sample cross-section, k being the absolute permeability value, $\mu_i$ being a fluid viscosity, $k_{ri}$ being the relative permeability vale, and $$\frac{\partial p}{\partial x}$$

being the applied pressure gradient.

10. The system of claim 7, wherein the memory further comprises functionality for:

determining a pressure drop within the reservoir region of interest using the simulation.

11. The system of claim 10, wherein the simulation of the reservoir region of interest is performed within an iterative time loop.

12. The system of claim 11, wherein the memory further comprises functionality for:

determining a stimulation plan based on the simulation of the reservoir region of interest over iterative time loop.

13. A non-transitory computer readable medium storing instructions executable by a computer processor, the instructions comprising functionality for:

obtaining, by a computer processor, stimulation data and reservoir data regarding a region of interest, wherein the stimulation data describe a water flooding process performed in the reservoir region of interest by one or more enhanced-recovery wells;

determining, by the computer processor, a multi-phase Darcy model for the reservoir region of interest using the reservoir data and the stimulation data, wherein the multi-phase Darcy model determines a fluid phase flow rate using a pressure gradient, an absolute permeability value, and a relative permeability value;

determining, by the computer processor, a plurality of relative permeability values for the reservoir region of interest based on a plurality of fluid-fluid interface correlations and an interpolating parameter, wherein the interpolating parameter determines intermediate relative permeability values of an intermediate salinity-level caused by at least one fluid-fluid interface among the plurality of fluid-fluid interfaces;

determining an amount of hydrocarbon production based on a simulation of the reservoir region of interest using the plurality of relative permeability values;

determining, by the computer processor, a plurality of ion concentrations for the reservoir region of interest based on the plurality of fluid-fluid interface correlations and the interpolating parameter;

solving transport equations to determine the ion concentrations and relative permeability values; and updating the relative permeability values based on a fluid-fluid interface viscosity correlation with ion concentration.

14. The non-transitory computer readable medium of claim 13, the instructions further comprise functionality for:

generating a workflow recovery model indicating the amount of hydrocarbon production based on the simulation of the reservoir region of interest.

15. The non-transitory computer readable medium of claim 13, wherein the multi-phase Darcy model corresponds to equation:

$$Q_i = A\frac{kk_{ri}}{\mu_i}\frac{\partial p}{\partial x},$$

$Q_i$ being a corresponding fluid phase flow rate, A being a rock sample cross-section, k being the absolute permeability value, $\mu_i$ being a fluid viscosity, $k_{ri}$ being the relative permeability vale, and $$\frac{\partial p}{\partial x}$$

being the applied pressure gradient.

16. The non-transitory computer readable medium of claim 13, the instructions further comprise functionality for:

determining a pressure drop within the reservoir region of interest using the simulation.

17. The non-transitory computer readable medium of claim 16, wherein the simulation of the reservoir region of interest is performed within an iterative time loop.

* * * * *